US007237293B2

(12) United States Patent
Kim

(10) Patent No.: US 7,237,293 B2
(45) Date of Patent: Jul. 3, 2007

(54) METHOD OF CONTROLLING A SHOE WASHING PROCESS OF A WASHING MACHINE

(75) Inventor: Hyun-Sook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 556 days.

(21) Appl. No.: 10/340,586

(22) Filed: Jan. 13, 2003

(65) Prior Publication Data

US 2004/0006829 A1 Jan. 15, 2004

(30) Foreign Application Priority Data

Jul. 11, 2002 (KR) ..... 2002-40260

(51) Int. Cl.
*D06F 21/02* (2006.01)

(52) U.S. Cl. ..... 8/158; 8/159; 68/12.02

(58) Field of Classification Search ..... 68/24, 68/58, 140, 12.02; 8/158
See application file for complete search history.

(56) References Cited

U.S. PATENT DOCUMENTS 1,682,500 A * 8/1928 Getz ..... 74/75
1,824,549 A * 9/1931 Hoyt ..... 8/94.15
2,671,456 A * 3/1954 Schultz et al. ..... 134/71
2,875,526 A * 3/1959 Engel et al. ..... 34/546
3,129,576 A * 4/1964 Werner et al. ..... 68/143
3,575,022 A * 4/1971 Steele ..... 68/24
4,435,964 A * 3/1984 Misawa ..... 68/19.2
4,566,144 A * 1/1986 Arneson ..... 15/3
4,617,743 A * 10/1986 Barnard ..... 34/109
4,691,400 A * 9/1987 Arneson ..... 15/3
4,782,544 A * 11/1988 Nystuen et al. ..... 8/159
4,784,666 A * 11/1988 Brenner et al. ..... 8/137
4,800,605 A * 1/1989 Arneson ..... 15/3
5,029,458 A * 7/1991 Obata et al. ..... 68/19.2
5,276,979 A * 1/1994 Gordon, Sr. ..... 34/600
5,289,703 A * 3/1994 Hiyashi et al. ..... 68/24
5,749,248 A * 5/1998 Kim ..... 68/4
5,862,684 A * 1/1999 Park ..... 68/4
5,887,456 A * 3/1999 Tanigawa et al. ..... 68/20
6,158,072 A * 12/2000 Baek et al. ..... 8/159
6,374,644 B1 * 4/2002 Rhode et al. ..... 68/20
6,604,298 B2 * 8/2003 Tomasi et al. ..... 34/600
6,726,362 B1 * 4/2004 Frisch et al. ..... 383/103
6,785,924 B1 * 9/2004 Rogers et al. ..... 8/159
2002/0040534 A1 * 4/2002 Strang et al. ..... 34/104

FOREIGN PATENT DOCUMENTS

GB 2 366 573 * 3/2002

(Continued)

OTHER PUBLICATIONS

European Patent Office 369 270 Nov. 1989.*
European Patent Office 1 1671609 Jan. 2002.*

*Primary Examiner*—Frankie L. Stinson
(74) *Attorney, Agent, or Firm*—Staas & Halsey LLP

(57) ABSTRACT

A method of controlling a shoe washing process of a washing machine performs washing, rinsing, and spin-drying operations. The method includes the operations of determining whether or not to select a shoe washing course, and washing the shoe according to a reversible operation time of a motor preset to correspond to the shoe washing course, when the shoe washing course is selected.

22 Claims, 6 Drawing Sheets

FOREIGN PATENT DOCUMENTS

| | | | |
|---|---|---|---|
| JP | 63-262196 | * | 10/1988 |
| JP | 4-197388 | * | 7/1992 |
| JP | 4-215795 | * | 8/1992 |
| JP | 4-336097 | * | 11/1992 |
| JP | 5-305197 | * | 11/1993 |
| JP | 9-271597 | * | 10/1997 |
| JP | 2000-139811 | * | 5/2000 |
| JP | 2000-342890 | * | 12/2000 |
| JP | 2001-178986 | * | 7/2001 |
| KR | 1996-4223 | | 12/1997 |

* cited by examiner

METHOD OF CONTROLLING A SHOE WASHING PROCESS OF A WASHING MACHINE

CROSS-REFERENCE TO RELATED APPLICATION

This application claims the benefit of Korean Application No. 2002-40260, filed Jul. 11, 2002, in the Korean Intellectual Property Office, the disclosure of which is incorporated herein by reference.

BACKGROUND OF THE INVENTION

1. Field of the Invention

The present invention relates generally to a washing machine, and more particularly, to a method of controlling a washing process of a washing machine, for effectively washing shoes, such as running shoes.

2. Description of the Related Art

As is well known to those skilled in the art, a washing machine is an appliance designed to wash laundry using water currents generated by agitating a pulsator in opposite directions according to reversible operations of a motor.

Recently, a variety of methods for washing shoes, such as running shoes and mules, as well as common clothes, in the washing machine have been proposed.

Since shoes, such as running shoes and mules, are different from common clothes in a material and a shape, the method of washing the shoes must be different from that of washing the common clothes. However, a conventional method of controlling a shoe washing process has a problem in that the washing, rinsing, and spin-drying operations of washing the shoes proceed in a same manner as operations of washing common clothes, so to effectively remove the dirt from the shoes is difficult.

SUMMARY OF THE INVENTION

Accordingly, an object is to effectively remove dirt from shoes by performing washing and rinsing operations using water currents suitable to wash the shoes.

Another object is to minimize a noise due to an impact of shoes as well as a physical shock applied by the shoes to a rotary tub during shoe washing and rinsing operations.

A further object is to increase a spin-drying efficiency, by performing a spin-drying operation in accordance with characteristics of the shoes.

Another object is to minimize a noise due to an impact of the shoes as well as a physical shock applied by the shoes to the rotary tub during a final spin-drying operation of the shoes.

Additional objects and advantages of the invention will be set forth in part in the description which follows and, in part, will be obvious from the description, or may be learned by practice of the invention.

In order to accomplish the above and other objects, a method of controlling a shoe washing process of a washing machine is provided, comprising the operations of determining whether or not to select a shoe washing course, and washing the shoes according to a reversible operation time of a motor preset to correspond to the shoe washing course, when the shoe washing course has been selected.

Further, a method of controlling a shoe spin-drying process of a washing machine is provided, comprising rotating a rotary tub at a high speed so that the shoes are forced toward an inside wall of the rotary tub to be adhered thereto, and stopping the rotary tub at least once so as to drop the shoe from the inside wall of the rotary tub during the high-speed rotation of the rotary tub.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
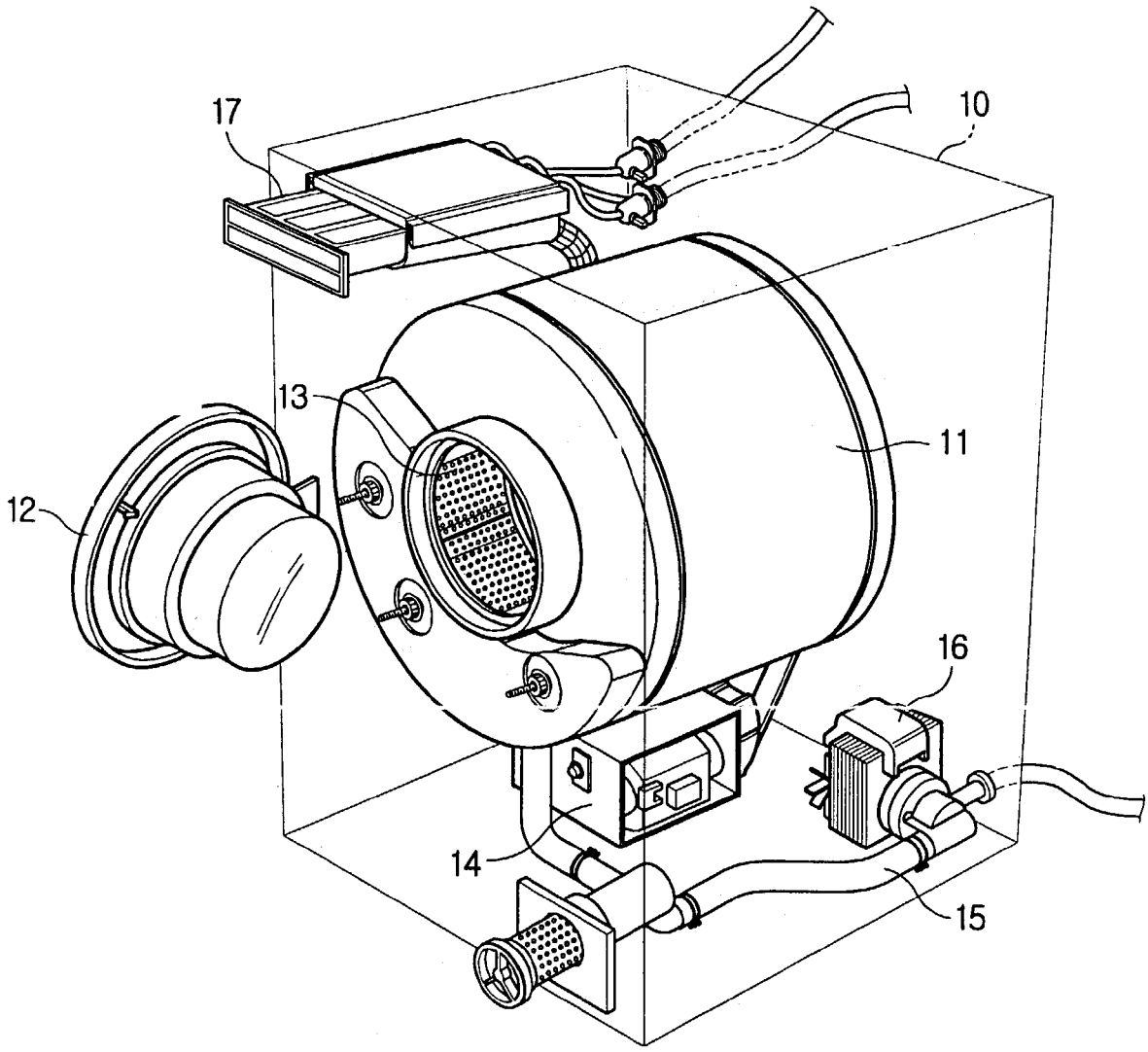
FIG. 1 is a perspective view showing a drum type washing machine according to an embodiment of the present invention.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Generally, a drum type washing machine is an appliance designed to wash laundry by dropping the laundry from a top of a rotary tub to a bottom of the rotary tub in the rotary tub having a drum shape, by rotation of the rotary tub. A drum type washing machine beats the laundry to wash the laundry and achieves a same effect as that obtained when washing the laundry by beating the laundry with a laundry stick. That is, the drum type washing machine has an advantage that relatively little damage to the laundry occurs, as twisting rarely occurs in the laundry during an operation of the drum type washing machine.

A related Korean Patent Application No. 1996-4223 which was filed with the Korean Intellectual Property Office (KIPO) and registered, discloses a method of washing shoes in a washing machine. According to this method, a preliminary washing operation is performed prior to a main washing operation and includes washing, rinsing, and spin-drying operations, because the shoes may be dirtier in comparison with common clothes. In the preliminary washing operation, soil or dust is removed from external surfaces of the shoes and the shoes are soaked in water so as to easily remove dirt from the shoes.

The present invention will be described herein with reference to the drum type washing machine, as an example of the washing machine.

FIG. 1 is a perspective view showing a drum type washing machine according to an embodiment of the present invention.

As shown in the FIG. 1, the drum type washing machine has a cabinet 10. A cylindrical drum 11 is horizontally set in the cabinet 10. A door 12 is mounted to a front of the cabinet 10 selectively closing an opening which is formed on the cylindrical drum 11. A rotary tub 13 is rotatably set inside the cylindrical drum 11 and is perforated on a sidewall of the rotary tub 13 to have a large number of water discharging perforations.

Figure 2:
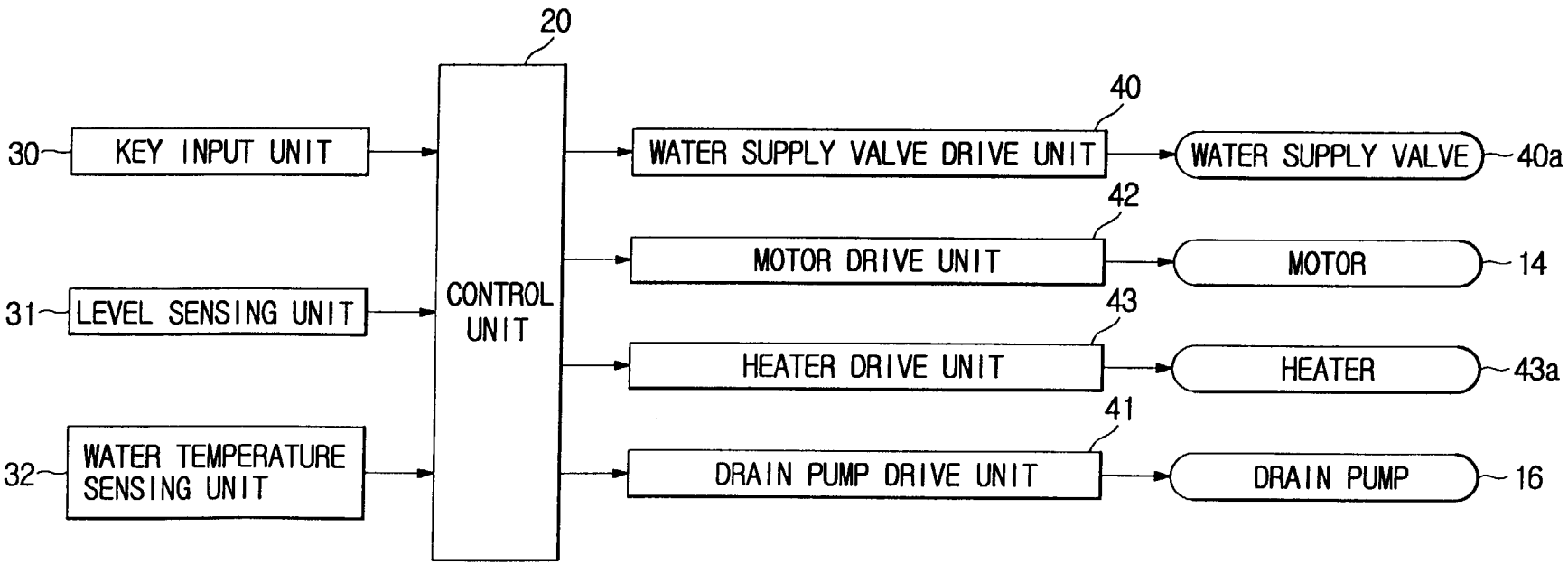
FIG. 2 is a block diagram showing a method of controlling the drum type washing machine for washing a shoe of FIG. 1.

The drum type washing machine has a motor 14 and a heater 43*a*, as shown in FIG. 2. The motor 14 is installed at a bottom of the cabinet 10 to rotate the rotary tub 13. The heater is installed under the cylindrical drum 11 to heat wash water.

A pulley (not shown) is installed on a shaft which passes through the rear wall of the rotary tub 13 and extends to an outside of the cylindrical drum 11. A belt (not shown) connects the pulley to the motor 14 such that a drive force of the motor 14 is transmitted to the rotary tub 13.

A drain hose 15 extends from the cylindrical drum 11 to drain the wash water. A drain pump 16 is installed at the bottom of the cabinet 10 to pump the wash water contained in the cylindrical drum 11.

A level sensor (not shown) is installed at an upper portion of the cabinet 10 sensing the wash water level. A temperature sensor (not shown) is installed at the door 12 sensing a temperature of the wash water in the cylindrical drum 11. A detergent container 17 is arranged at an upper position inside the cabinet 10 supplying detergent to the drum 11.

FIG. 2 is a block diagram showing a method of controlling the drum type washing machine washing shoes according to the embodiment of the present invention.

As shown in FIG. 2, a key input unit 30, a level sensing unit 31, and a water temperature sensing unit 32 are electrically connected to input terminals of a control unit 20. A user inputs a washing course, such as a clothes washing course or a shoe washing course, through the key input unit 30. The level sensing unit 31 has a level sensor and outputs a detected level signal to communicate a detected wash water level. The water temperature sensing unit 32 outputs a water temperature signal to communicate a detected water temperature.

A water supply valve drive unit 40, a drain pump drive unit 41, a motor drive unit 42, and a heater drive unit 43 are electrically connected to output terminals of the control unit 20. The water supply valve drive unit 40 operates to selectively open a water supply valve 40*a* supplying wash water into the rotary tub 13. The drain pump drive unit 41 operates the drain pump 16 in response to a control signal transmitted from the control unit 20, so as to discharge contaminated wash water from the rotary tub 13 to an outside. The motor drive unit 42 alternately rotates the motor 14 in opposite directions so as to agitate the rotary tub 13 at the washing and rinsing operations in response to a control signal of the control unit 20, thus generating desirable water currents. Further, the motor drive unit 42 controls a rotating speed of the motor 14 so as to control a rotating speed of the rotary tub 13 at a spin-drying operation in response to a control signal from the control unit 20. The heater drive unit 43 operates the heater 43*a* to heat wash water until a water temperature reaches a predetermined temperature in response to a control signal from the control unit 20.

Figure 3:
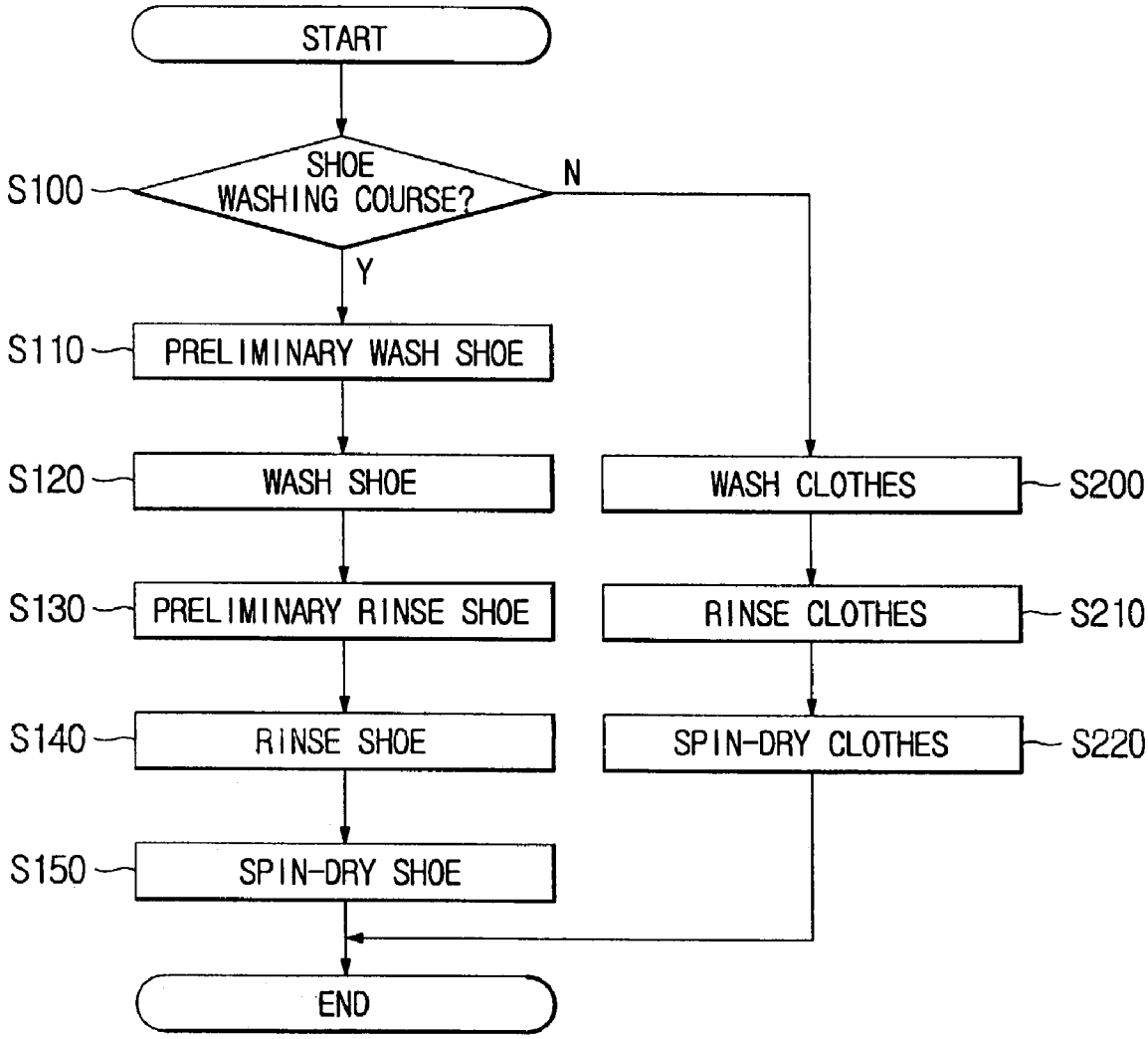
FIG. 3 is a flowchart showing a method of controlling washing, rinsing and spin-drying operations of the drum type washing machine for washing a shoe of FIG. 1.

FIG. 3 is a flowchart showing a method of controlling washing, rinsing and spin-drying operations of the drum type washing machine washing a shoe of FIG. 1.

As shown in the FIG. 3, a user first puts shoes, such as running shoes or mules, in the rotary tub 13.

The control unit 20 reads the output signal of the key input unit 30, and determines whether or not a shoe washing course has been input at operation S100.

If the shoe washing course has not been selected at operation S100, the control unit 20 commands generation of water currents for a common clothes washing course so as to perform washing and rinsing operations at operations S200 and S210, respectively. When the rinsing operation is completed at S210, the rotary tub 13 is rotated at a high speed in one direction, thus performing a spin-drying operation at operation S220.

Further, if the shoe washing course is selected at operation S100, the control unit 20 commands performance of a preliminary washing operation at operation S110, to remove dirt from shoes and to soak dirty shoes in heated wash water.

Once the preliminary washing operation is completed at operation S100, a main washing process proceeds. First, the control unit 20 sends a control signal to the motor drive unit 42 to drive the motor 14. As the motor 14 is driven, the rotary tub 13 is rotated by a pulley and a belt, and generates water currents to wash the shoes, thus washing the shoes at operation S120. At this time, in response to a control signal of the control unit 20, a reversible operating time (a reversible rotating time and a stop time) of the motor 14 is set to be shorter than a reversible operating time of the motor 14 at the clothes washing operation at S200 so as to control a rotating angle of the rotary tub 13. For example, the rotary tub 13 is rotated at an angle of 90° or less so as to maximize contact of the shoes with the water currents, thus preventing the shoes from damaging an inside wall of the rotary tub 13 caused by a 360° rotation. In addition, the rotary tub 13 is intermittently rotated at an angle of 360° so as to allow the water currents to be uniformly contacted by the shoes, thus increasing the shoe washing efficiency.

When the washing operation at S120 is completed, the control unit 20 sends a control signal to the drain pump drive unit 41 operating the drain pump 16, so that wash water contaminated during the washing operation at S120 is discharged to an outside. Next, in response to a control signal from the control unit 20, the drain valve drive unit 40 opens the drain valve 40*a* supplying clean water to the washing machine. Once the clean water supplied to the washing machine reaches a preset volume, a preliminary rinsing operation is performed at operation S130 in order to remove impurities, such as lint, attached to an exterior or an interior of the shoes during the washing operation at S120. At this time, the control unit 20 sends a control signal to the drain pump drive unit 41 operating the drain pump 16, so that dirty wash water is discharged to the outside. Thereafter, in response to control signals from the control unit 20, the drain valve drive unit 40 opens the drain valve 40*a* to newly supply fresh water to the washing machine, and the motor drive unit 42 rotates the motor 14 at a preset rotating speed rotating the rotary tub 13, thus performing the preliminary rinsing operation at S130.

When the preliminary rinsing operation at S130 is completed, the control unit 20 sends a control signal to the drain pump drive unit 41 operating the drain pump 16, so that the wash water contaminated during the preliminary rinsing operation at S130 is discharged to the outside. Further, the control unit 20 sends a control signal to the water supply valve drive unit 40 to open the water supply valve 40*a*, so that fresh water is newly supplied to the washing machine. Once the supplied water reaches a preset volume, water currents for the shoe are generated in a same manner at the operation S120, thus performing the rinsing operation several times at operation S140.

When the rinsing operation is completed at operation S140, the control unit 20 sends a control signal to the drain pump drive unit 41 so as to discharge the wash water to the outside by operating the drain pump 16. In response to a control signal of the control unit 20, the motor drive unit 42 controls a rotating speed of the motor 16, so that the spin-drying operation at operation S150 is performed as the shoes are centrifugally adhered to an inside wall of the rotary tub 13, and the motor 14 is intermittently stopped to drop the shoes from the inside wall of the rotary tub 13, at operation S150. Thus, noise generated when spin-drying the shoes is minimized, and the shoes are dropped from the inside wall of the rotary tub 13 in response to a stop of the motor 14, so that bottom surfaces of the shoes do not block water discharging perforations, thus preventing a spin-drying efficiency from being reduced.

Figure 4:
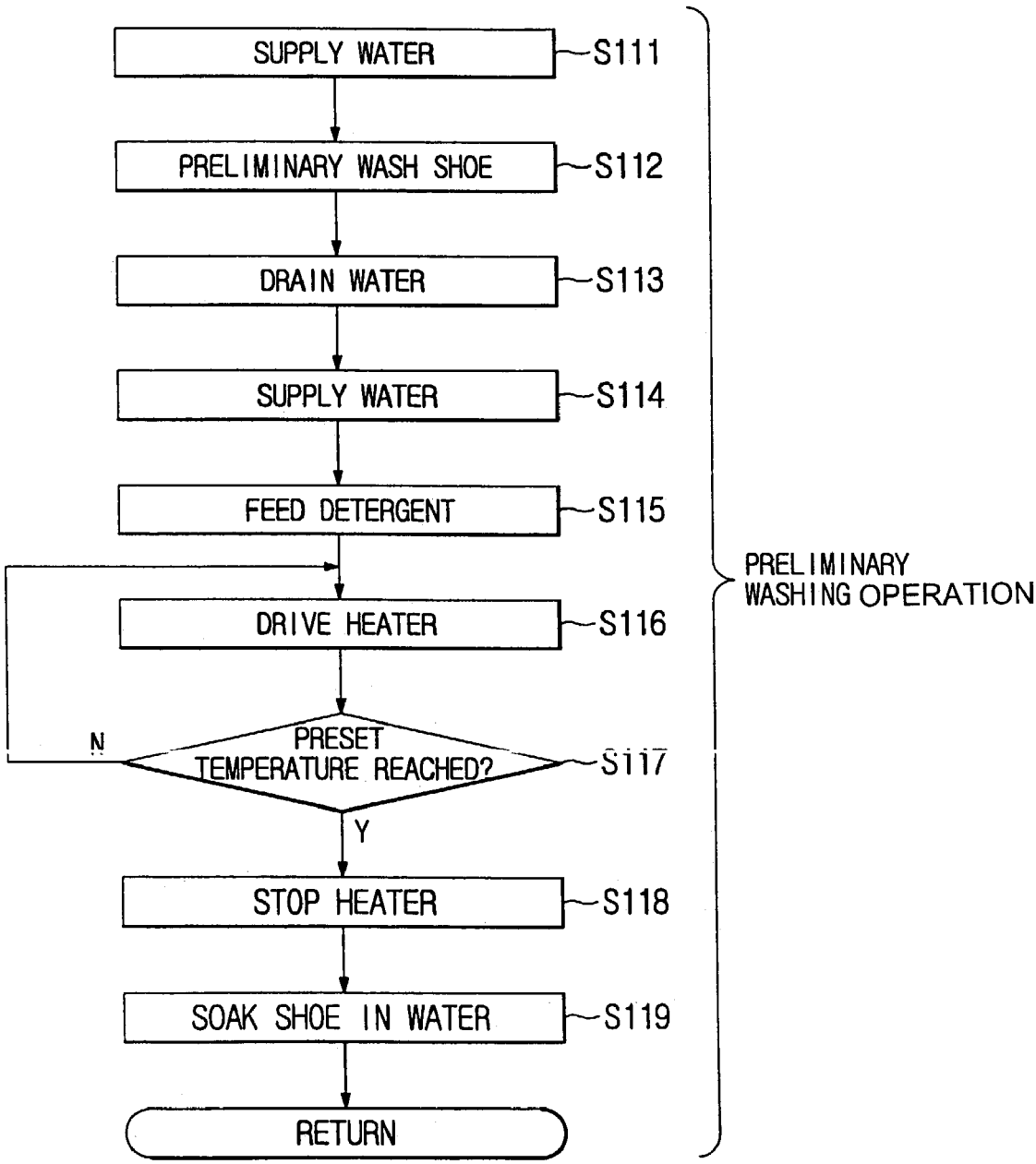
FIG. 4 is a flowchart showing a method of controlling a preliminary washing operation of FIG. 3.

FIG. 4 is a flowchart showing a method of controlling a preliminary washing operation of FIG. 3.

As shown in FIG. 4, when the preliminary washing operation is performed, the control unit 20 sends a control signal to the water supply valve drive unit 40 so that a small quantity of water is supplied to the washing machine by opening a water supply valve 40*a*.

When a predetermined amount of the water is supplied to the washing machine, the control unit 20 sends a control signal to the motor drive unit 42 driving the motor 14. As the motor 14 is driven, the rotary tub 13 is rotated to perform the preliminary washing operation, thus removing soil and dust from the shoes at operation S112.

After removing the soil and the dust from the shoes, the control unit 20 sends a control signal to the drain pump drive unit 41 so as to discharge dirty wash water to the outside by operating the drain pump 16 at operation S113.

After the dirty wash water is discharged to the outside, in response to control signals from the control unit 20, a detergent container 17 is operated while the water supply valve 40*a* is operated by the water supply valve drive unit 40, thus supplying a predetermined quantity of wash water and detergent into the rotary tub 13 at operations S114 and S115.

Once the wash water and detergent are supplied to the rotary tub 13, the control unit 20 sends a control signal to the motor drive unit 42 to begin operating the motor 14. At this time, the motor 14 controls the rotary tub 13 to be alternately rotated in opposite directions at an angle of 90° or less. After the detergent is dissolved by a rotation of the rotary tub 13, the heater drive unit 43 drives the heater 43*a* so that a temperature of the wash water reaches a preset temperature, for example 30° C. to 40° C., at operation S116. In this case, the temperature of the wash water is preset to be lower than during a respective clothes washing course at operation S100, thus preventing the shoe from being thermally deformed due to high temperature.

While the heater 43*a* is operating, the control unit 20 reads the temperature of the wash water and checks whether the temperature is at a preset temperature or greater, by a water temperature sensing unit 32, at operation S117.

Once the water temperature reaches the preset temperature at operation S117, the control unit 20 sends a control signal to the heater drive unit 43 to stop the heater 43*a* at operation S116.

After stopping the heater 43*a*, in response to a control signal from the control unit 20, the shoe is soaked in the water for a preset period of time, thus removing dirt from the shoe at operation S118. At this time, the control unit 20 sends a control signal to the motor drive unit 20 controlling the motor 14 such that the rotary tub 13 is rotated at a preset angle, for example 90°.

Figure 5:
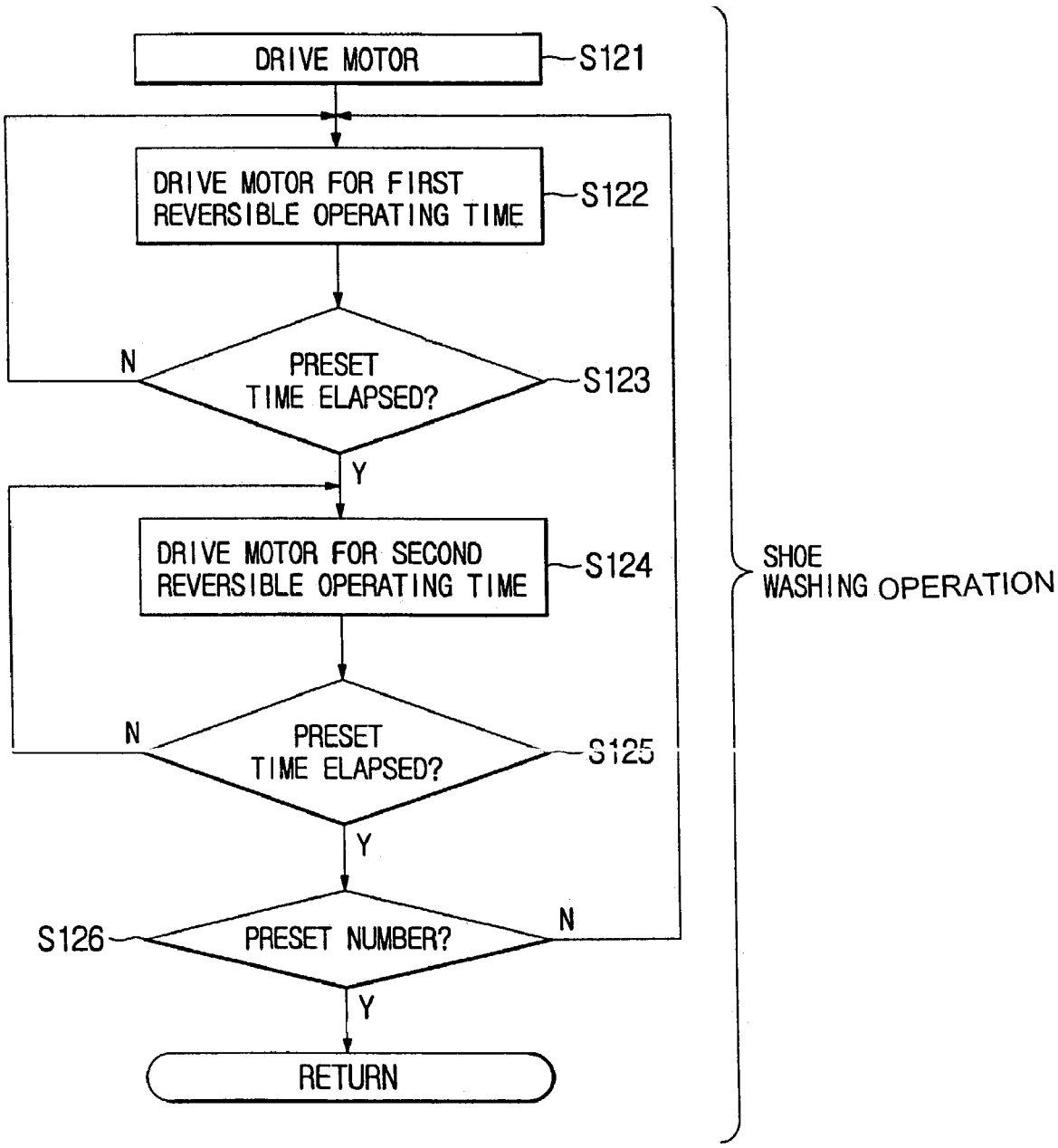
FIG. 5 is a flowchart showing a method of controlling a shoe washing operation of FIG. 3.

FIG. 5 is a flowchart showing a method of controlling a shoe washing operation of FIG. 3.

Referring to FIG. 5, the control unit 20 sends a control signal to the motor drive unit 42 operating the motor 14 at operation 121, after the preliminary washing operation is completed.

After operating the motor 14, the control unit 20 sends a control signal to the motor drive unit 42, so that the motor 14 is operated for a first reversible operating time which is preset to wash the shoe by rotating the rotary tub 13 within a predetermined angular range at operation S122. For the first reversible operating time of the motor 14, a reversible operating time and a stop time of the motor 14 are preset such that the rotary tub 13 is rotated within a preset rotating angle, for example 90°.

When the washing operation is performed by rotating the rotary tub 13 in response to the drive of the motor 14 for the first reversible operating time, the control unit 20 counts a wobbling washing time, and compares the counted wobbling washing time with a preset time, and determines whether or not the wobbling washing time exceeds the preset time at operation S123.

In the case where the wobbling washing time exceeds the preset time, in response to a control signal from the control unit 20, the motor 14 is driven for a second reversible operating time so as to wash the shoe by rotating the rotary tub 13 at a preset angle, for example 360°, at operation S124.

When the washing operation is performed by rotating the, rotary tub 13 at an angle of 360° in response to the motor drive unit 42 driving the motor 14 for the second reversible operating time, the control unit 20 counts a washing time during a period having a rotation angle of 360°, and compares the counted washing time with a preset time, and determines whether or not the washing time exceeds the preset time at operation S125.

If the washing time exceeds the preset time, the control unit 20 determines whether or not a number of washings for the first reversible operating time and the second reversible operating time exceeds a preset number at operation S126.

In the case where the number of washings has not reached the preset number, the control unit 20 provides commands to return to operation S122 so as to perform the washing operation again when the motor 14 is driven for the first and second reversible operating times.

However, when the number of washings exceeds the preset number at operation S126, the control unit 20 provides commands to return to a preset operation.

Figure 6:
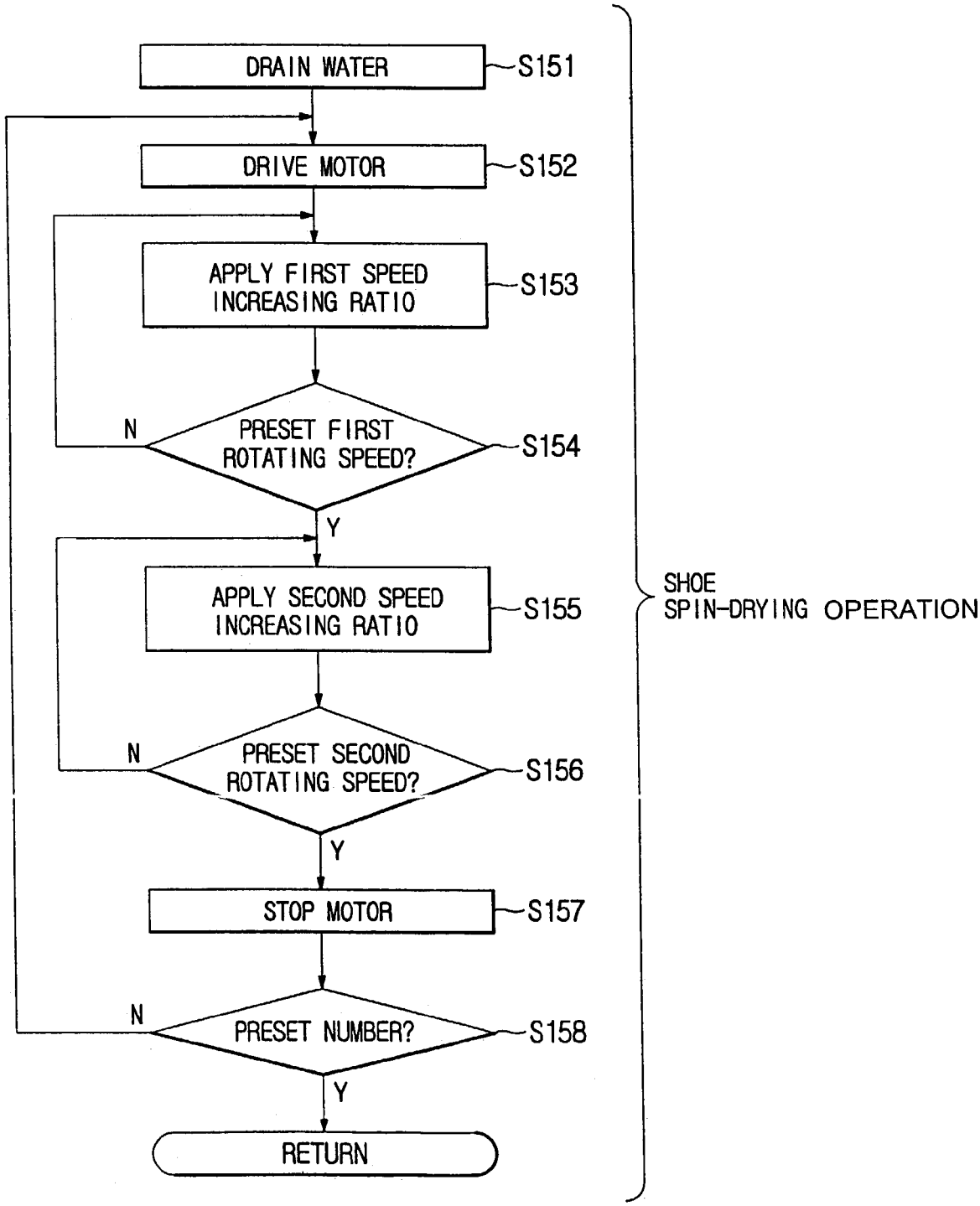
FIG. 6 is a flowchart showing a method of controlling a shoe spin-drying operation of FIG. 3.

FIG. 6 is a flowchart showing a method of controlling a shoe spin-drying operation of FIG. 3.

As shown in FIG. 6, at a final spin-drying operation, the control unit 20 sends a control signal to the drain pump drive unit 41 discharging the wash water to the outside by operating the drain pump 16 at operation S151.

After the wash water is discharged to the outside, the control unit 20 controls a rotating speed of the motor 14 by the motor drive unit 42 at operation S152, to rotate the rotary tub 13 at a preset rotating speed so that the shoe is forced toward the inside wall of the rotary tub 13 to be adhered thereto. At this time, when the motor drive unit 42 drives the motor 14 in response to a control signal from the control unit 20, the rotary tub 13 is primarily rotated at a low speed while being increased in the rotating speed thereof at a first speed-increasing ratio until the rotary tub 13 reaches a preset first rotating speed such that the shoe is forced toward the inside wall of the rotary tub 13 to be adhered thereto, at operation S153.

The control unit 20 determines whether or not the preset first rotating speed has been reached, based on a rotating speed of the motor 14 at operation S154.

In the case that the preset first rotating speed has been reached, in response to a control signal of the control unit 20, the rotary tub 13 is secondarily rotated at a high speed while being increased at a rotating speed thereof at a second speed-increasing ratio until reaching a second rotating speed, at operation S155. In this case, the second speed-increasing ratio is preset to be higher than the first speed-increasing ratio, and the second rotating speed is preset to be higher than the first rotating speed.

The control unit 20 determines whether or not the preset second rotating speed has been reached based on the rotating speed of the motor 14.

If the spin-drying operation is performed as the shoe adheres to the inside wall of the rotary tub 13, the bottom surface of the shoe closes a part of the water discharging perforations, thus lowering a spin-drying efficiency. To prevent a reduction in the spin-drying efficiency, when the rotary tub 13 reaches the second rotating speed at operation S156, the motor 14 is temporarily stopped for a preset stop time by the motor drive unit 42, in response to a control signal from the control unit 20, so that the shoe is dropped from the inside wall of the rotary tub 13, at operation S157.

Thereafter, the control unit 20 determines whether or not a number of drive operations and stop operations of the motor 14 has reached a preset number at operation S158.

If the number of the drive operations and stop operations of the motor 14 has not reached the preset number, the control unit 20 commands a return of the procedure to operation S152, thus performing the motor drive operations and the motor stop operations again.

in a case that the preset number has been reached at operation S158, the control unit 20 commands a return of the procedure to a preset operation.

As described above, the washing machine is directed to effectively remove dirt from shoes by performing washing and rinsing operations using water currents suitable to wash the shoes and allows noise due to an impact of the shoes to be minimized during the shoe washing and rinsing operations.

Further, the washing machine is directed to minimize a physical shock applied by the shoes to the wall of a rotary tub, during shoe washing and rinsing operations.

According to the method of controlling a shoe washing process of the washing machine, a final spin-drying operation is performed in accordance with the characteristic of the shoes, thus increasing the spin-drying efficiency while spin-drying the shoes and allows noise due to the impact of the shoes to be minimized during the final spin-drying operation of the shoes.

Further, the method allows the physical shock applied by the shoes to the inside wall of the rotary tub to be minimized during the final spin-drying operation of the shoes.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of controlling a shoe washing process of a washing machine performing washing, rinsing, and spin-drying operations, comprising:

determining whether to select a shoe washing course; and washing a shoe according to a reversible operation time of a motor preset to correspond to the shoe washing course, when the shoe washing course is selected, wherein said reversible operation time of the motor at a washing operation or a rinsing operation of the shoe washing course is preset to be shorter than a reversible operation time of the motor at a washing operation or a rinsing operation of a common clothes washing course.

2. The method according to claim 1, wherein said reversible operation time of the motor at the washing operation or the rinsing operation of the shoe washing course is preset such that a rotary tub is rotated within a preset rotating angle.

3. The method according to claim 2, wherein said preset rotating angle is 90° or less.

4. The method according to claim 1, wherein said reversible operation time of the motor at the washing operation or the rinsing operation of the shoe washing course is preset such that a rotation of a rotary tub at the preset rotating angle keeps pace with a rotation of the rotary tub at an angle of 360°.

5. A method of controlling a shoe washing process of a washing machine performing washing, rinsing, and spin-drying operations, comprising:

determining whether to select a shoe washing course; and washing a shoe according to a reversible operation time of a motor preset to correspond to the shoe washing course, when the shoe washing course is selected, wherein said shoe washing course performs a preliminary washing operation, before performing the washing and rinsing operations, so as to remove dirt from an external surface of the shoe and soak the shoe in water, and wherein at said preliminary washing operation, wash water is heated to a temperature preset according to a type of the shoe, and the shoe is soaked in the heated wash water.

6. The method according to claim 5, wherein said temperature of the wash water in the preliminary washing operation of the shoe is preset to be a lower temperature than a temperature of the wash water in a corresponding washing operation for common clothes.

7. A method of controlling a shoe washing process of a washing machine performing washing, rinsing, and spin-drying operations, comprising:

determining whether to select a shoe washing course; and washing a shoe according to a reversible operation time of a motor preset to correspond to the shoe washing course, when the shoe washing course is selected, wherein a preliminary rinsing operation is performed removing dirt from the shoe using a preset amount of clean water, after finishing the washing operation.

8. A method of controlling a shoe washing process of a washing machine performing washing, rinsing, and spin-drying operations, comprising:

determining whether to select a shoe washing course; and washing a shoe according to a reversible operation time of a motor preset to correspond to the shoe washing course, when the shoe washing course is selected, wherein the reversible operation time of the motor at a spin-drying operation for the shoe washing course is preset such that the shoe drops from an inside wall of a rotary tub into the rotary tub at least one time while the shoe is rotated and forced to the inside wall of the rotary tub to be adhered thereto.

9. A method of controlling a shoe spin-drying process of a washing machine, comprising:

stopping a rotary tub from rotating at least one time so as to drop a shoe, adhering from an inside wall of the rotary tub during high speed rotation of the rotary tub, into the rotary tub, wherein at the operation of rotating the rotary tub at the high speed, the rotary tub is primarily rotated at a low speed while being increased in a rotating speed thereof at a first speed-increasing ratio until the rotary tub reaches a preset first rotating speed such that the shoe is forced toward the inside wall of the rotary tub to be adhered thereto, and when reaching the first rotating speed, the rotary tub is secondarily rotated at a high speed while being increased in the rotating speed thereof at a second speed-increasing ratio until reaching a second rotating speed, said second speed-increasing ratio being preset to be higher than the first speed-increasing ratio, said second rotating speed being preset to be higher than the first rotating speed.

10. A method of controlling a shoe washing process of a washing machine having a shoe washing course, comprising:

selecting the shoe washing course; and washing or rinsing one or more shoes according to a reversible operation time corresponding to the selected shoe washing course, wherein said reversible operation time during the shoe washing course at said washing or said rinsing is set to be shorter in duration than a reversible operation time during a corresponding common clothes washing course at a respective washing operation or a respective rinsing operation.

11. The method according to claim 10, wherein said reversible operation time during the shoe washing course at said washing or said rinsing is set such that a rotary tub is rotated according to a preset rotating angle.

12. The method according to claim 11, wherein said preset rotating angle is 90° or less.

13. The method according to claim 10, wherein said washing or rinsing comprises:

rotating the rotary tub for the reversible operation time; and if a washing time is less than or equal to a preset time, repeatedly rotating the rotary tub for a subsequent reversible operation time until a total washing time exceeds the preset time.

14. A method of controlling a shoe washing process of a washing machine having a shoe washing course, comprising:

selecting the shoe washing course;

washing or rinsing one or more shoes according to a reversible operation time corresponding to the selected shoe washing courses, wherein said reversible operation time of the motor at a washing operation or a rinsing operation of the shoe washing course is preset to be shorter than a reversible operation time of the motor at a washing operation or a rinsing operation of a common clothes washing course; and intermittently rotating a rotary tub at an angle of 360° during said washing so as to allow the one or more shoes to contact water currents.

15. A method of controlling a shoe washing process of a washing machine having a shoe washing course, comprising:

selecting the shoe washing course; and washing or rinsing one or more shoes according to a reversible operation time corresponding to the selected shoe washing course, wherein said shoe washing course comprises:

preliminary washing, prior to said washing and said rinsing, to remove dirt from surfaces of the one or more shoes and to soak the shoes in water; and wherein said preliminary washing operation comprises:

heating wash water to a temperature according to a type of the one or more shoes, and soaking the one or more shoes in the heated wash water.

16. The method according to claim 15, wherein said temperature of the wash water in said preliminary washing of the one or more shoes is a lower temperature than a temperature of the wash water in a corresponding washing operation for common clothes.

17. A method of controlling a shoe washing process of a washing machine having a shoe washing course, comprising:

selecting the shoe washing course; and washing or rinsing one or more shoes according to a reversible operation time corresponding to the selected shoe washing course, wherein said shoe washing course comprises:

preliminary rinsing to remove dirt from the one or more shoes using a preset amount of clean water, after finishing said washing.

18. A method of controlling a shoe washing process of a washing machine having a shoe washing course, comprising:

selecting the shoe washing course; and washing or rinsing one or more shoes according to a reversible operation time corresponding to the selected shoe washing course, wherein said shoe washing course comprises:

spin-drying the one or more shoes such that a reversible operation time during spin-drying is preset so that the one or more shoes drop from an inside wall of a rotary tub into the rotary tub at least one time while the one or more shoes are rotated and forced to the inside wall of the rotary tub to be adhered thereto.

19. A method of controlling a shoe spin-drying process of a washing machine having a rotary tub with an inside wall, comprising:

rotating the rotary tub at a speed such that a shoe is forced toward the inside wall of the rotary tub to be adhered thereto; and stopping the rotary tub at least one time so as to drop the shoe from the inside wall of the rotary tub into the rotary tub during the rotation of the rotary tub, wherein the rotating of the rotary tub at the speed comprises:

increasing a rotation speed of the rotary tub at a first speed-increasing ratio until the rotation speed of the rotary tub is at a first rotating speed such that the shoe adheres to the inside wall of the rotary tub; and when the rotary tub reaches the first rotating speed, increasing the rotation speed of the rotary tub at a second speed-increasing ratio until the rotation speed of the rotary tub is at a second rotating speed, the second speed-increasing ratio being higher than the first speed-increasing ratio and the second rotating speed being higher than the first rotating speed.

20. A method of controlling a shoe washing process of a washing machine, comprising:

selecting a shoe washing course;

preliminary washing to remove dirt from a surface of the one or more shoes and to soak the one or more shoes in water; and washing the one or more shoes according to a reversible operation time corresponding to the selected shoe washing course said reversible operation time during the shoe washing course at said washing is set to be shorter in duration than a reversible operation time during a corresponding common clothes washing course at a respective washing operation.

21. A method of controlling a shoe washing process of a washing machine, comprising:

selecting a shoe washing course;

rinsing one or more shoes according to a reversible operation time corresponding to the selected shoe washing course said reversible operation time during the shoe washing course at said rinsing is set to be shorter in duration than a reversible operation time during a corresponding common clothes washing course at a respective rinsing operation; and preliminary rinsing to remove dirt from the one or more shoes using a preset amount of wash water, prior to said rinsing.

22. A method of controlling a washing process of a washing machine, comprising:

selecting the spin-drying item washing course;

rinsing one or more spin-drying items according to a reversible operation time corresponding to the selected spin-drying item washing course said reversible operation time during the spin-drying item washing course at said rinsing is set to be shorter in duration than a reversible operation time during a corresponding common clothes washing course at a respective rinsing operation; and preliminary rinsing to remove dirt from one or more shoes using a preset amount of wash water, prior to said rinsing.

* * * * *

UNITED STATES PATENT AND TRADEMARK OFFICE

CERTIFICATE OF CORRECTION

PATENT NO. : 7,237,293 B2
APPLICATION NO. : 10/340586
DATED : July 3, 2007
INVENTOR(S) : Hyun-Sook Kim It is certified that error appears in the above-identified patent and that said Letters Patent is hereby corrected as shown below:

Column 9, Line 50, change “courses,” to --course,--.

Signed and Sealed this

Twenty-seventh Day of November, 2007

JON W. DUDAS
*Director of the United States Patent and Trademark Office*